United States Patent [19]

Drain

[11] Patent Number: 4,719,323

[45] Date of Patent: Jan. 12, 1988

[54] SIMPLIFIED VEHICLE LIGHTING SWITCH

[76] Inventor: John A. Drain, 5045 E. Outer Dr., Apt. K-308, Detroit, Mich. 48234

[21] Appl. No.: 941,233

[22] Filed: Dec. 12, 1986

[51] Int. Cl.[4] ..... H01H 19/58

[52] U.S. Cl. ..... 200/11 R; 200/11 J

[58] Field of Search ..... 200/11 R, 11 D, 11 DA, 200/11 E, 11 EA, 11 G, 11 J, 11 K, 11 TC, 17 R, 17 B, 336, 296, 294; 307/10 LS

[56] References Cited

U.S. PATENT DOCUMENTS

| | | | |
|---|---|---|---|
| 3,167,620 | 1/1965 | Keyser et al. | 200/11 R |
| 3,226,991 | 1/1966 | Hartsock | 200/11 DA X |
| 3,270,334 | 8/1966 | Steele, Jr. | 200/11 G X |
| 3,391,259 | 7/1968 | Massengale | 200/11 R |
| 4,232,207 | 11/1980 | Kuhl et al. | 200/11 R |
| 4,246,453 | 1/1981 | Marchese et al. | 200/11 R |

*Primary Examiner*—J. R. Scott

*Attorney, Agent, or Firm*—Peter A. Taucher; John E. McRae

[57] ABSTRACT

A rotary circuit-selector switch wherein a manual actuator knob must be pushed in and then rotated in order to effect a switching action. A releasable retainer or detent assembly is provided within the switch housing to maintain the switch in selected positions of adjustment. Two spaced parallel boards are located in the housing to operatively mount the rotary switch element; one of the boards acts as an electrical circuit board. Preferably an electrothermal type circuit breaker is mounted in the housing to protect the switch circuitry from current overloads.

9 Claims, 3 Drawing Figures

SIMPLIFIED VEHICLE LIGHTING SWITCH

BACKGROUND AND SUMMARY OF THE INVENTION

This invention relates to an improvement on a pre-existing electrical switch now used on various U.S. Army military vehicles under the designation MS 51113. The existing switch is employed to control current flow to vehicle lights, e.g., service lights (headlights), stop lights, blackout lights, parking lights, and instrument panel lights.

The existing switch comprises a housing structure mounted on the vehicle instrument panel. Three selectively actuable manual levers are carried on the front wall of the housing structure. One of the three levers operates a first selector switch element that controls current flow to the service lights, stop lights and blackout lights. A second lever operates a second selector switch element that controls current flow to the parking lights and instrument panel lights (bright or dim). The third lever functions as a lockout device for preventing movement of the first lever except when the third lever is deliberateley moved to an "unlock" position. The third lever prevents tampering of the switch mechanism by persons unfamiliar with switch structure operation. The third lever also prevents inadvertant switch adjustments due to external forces, e.g., vehicle vibration.

The present invention concerns simplification of the pre-existing switch structure. Under the present invention the "lockout" function is incorporated into the switch-actuating levers, thereby reducing the number of levers (from three to two). Principal result is cost reduction, although there may also be some operating benefits. With my improved arrangement the switch-actuating levers are susceptible to one-handed operation, whereas with the conventional arrangement two hands are required (one to depress the lockout lever and one to operate the switch lever). With the conventional arrangement soldiers sometimes attempted to permanently set the lockout lever in the "unlock" position (in order to make switch operation easier); often the switch structure was damaged in the process, thereby necessitating switch replacement.

Under my invention the "lockout" function is incorporated directly into the switch-operating levers. Each lever structure is designed to be successively movable in two senses, i.e., a push-in motion to "unlock", and a rotary motion to effect electrical switching. The two-direction motion can be accomplished with one hand.

As an ancillary feature I contemplate the inclusion of a "cycling" type circuit breaker into the switch housing. The circuit breaker is preferably a removable "drawer-type" structure that can be readily withdrawn through an opening in the front wall of the switch housing when the circuit breaker needs replacement.

THE DRAWINGS

DESCRIPTION OF PREFERRED EMBODIMENT

Figure 1:
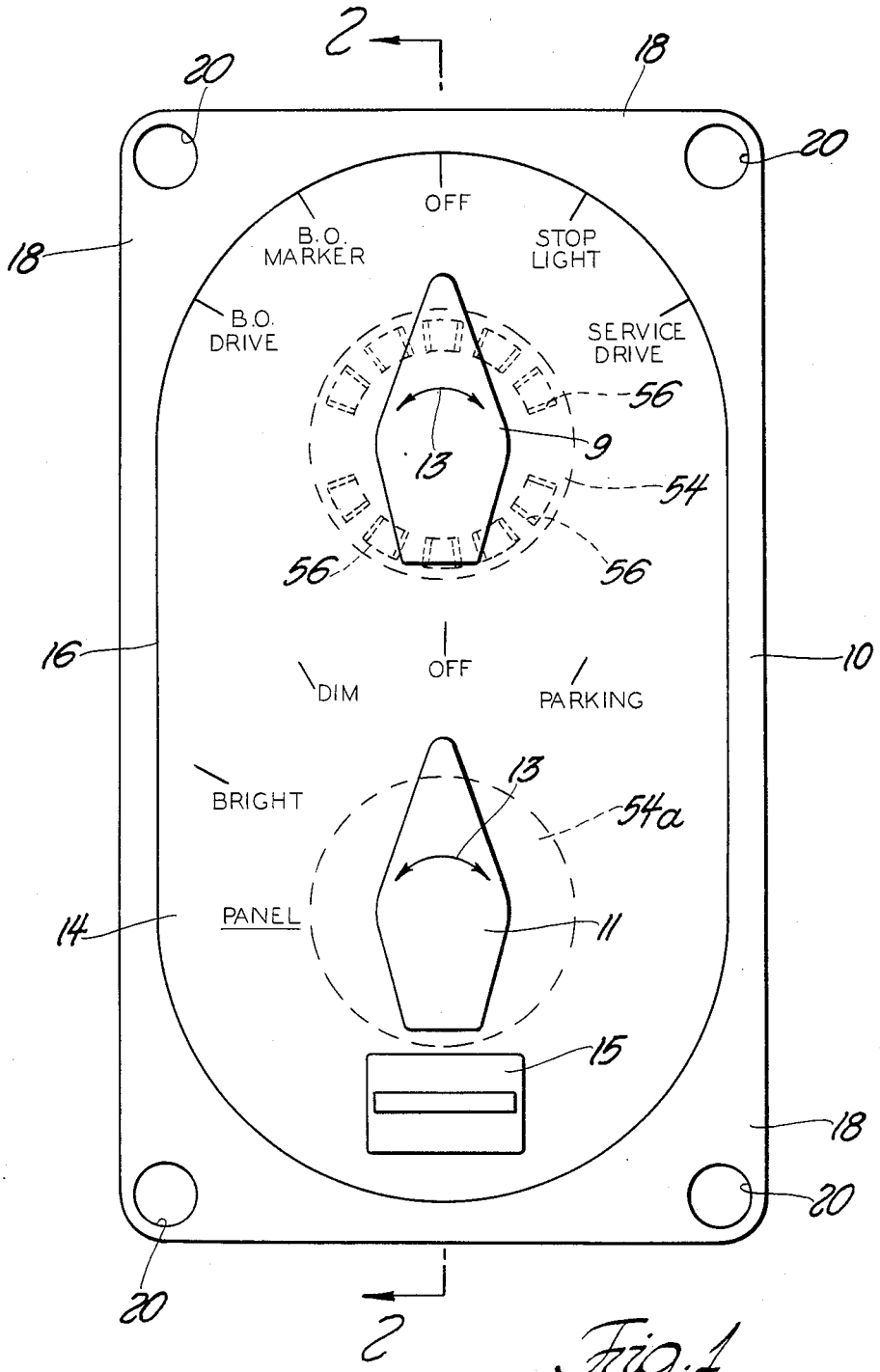
FIG. 1 is a front view of a selector switch embodying my invention.

Referring in greater detail to the drawings, there is shown a rotary electric switch mechanism that includes a housing 10 and cover 12 (that closes the rear end of the housing). The housing includes a front wall 14 and peripheral side wall 16. A peripheral flange 18 extends around the housing periphery to normally seat against the rear face of a vehicle instrument panel 22. Openings 20 in flange 18 accommodate screws (not shown) for mounting housing 10 on the instrument panel. The forward portion of housing 10 projects through panel 22, as shown in FIG. 2.

As shown in FIG. 1, two external manual knobs 9 and 11 are positioned in front of housing front wall 14 for manual rotation to various different positions of adjustment. Each knob has two degrees of motion, i.e., inwardly toward wall 14 and then rotationally as indicated by arrows 13. Knob 9 controls current flow to the service lights (headlights), stop lights and blackout lights (low intensity lights used in wartime to minimize detection by enemy forces). Knob 11 controls current flow to the parking lights and the instrument panel lights. The area below knob 11 is occupied by the front wall of a circuit breaker structure 15. Structure 15 is a drawer-type unit that can be pulled out of housing 10 (through an opening in wall 14) when it becomes necessary to replace the circuit breaker. Details of the switch structures and circuit breaker are shown in FIG. 2.

Figure 2:
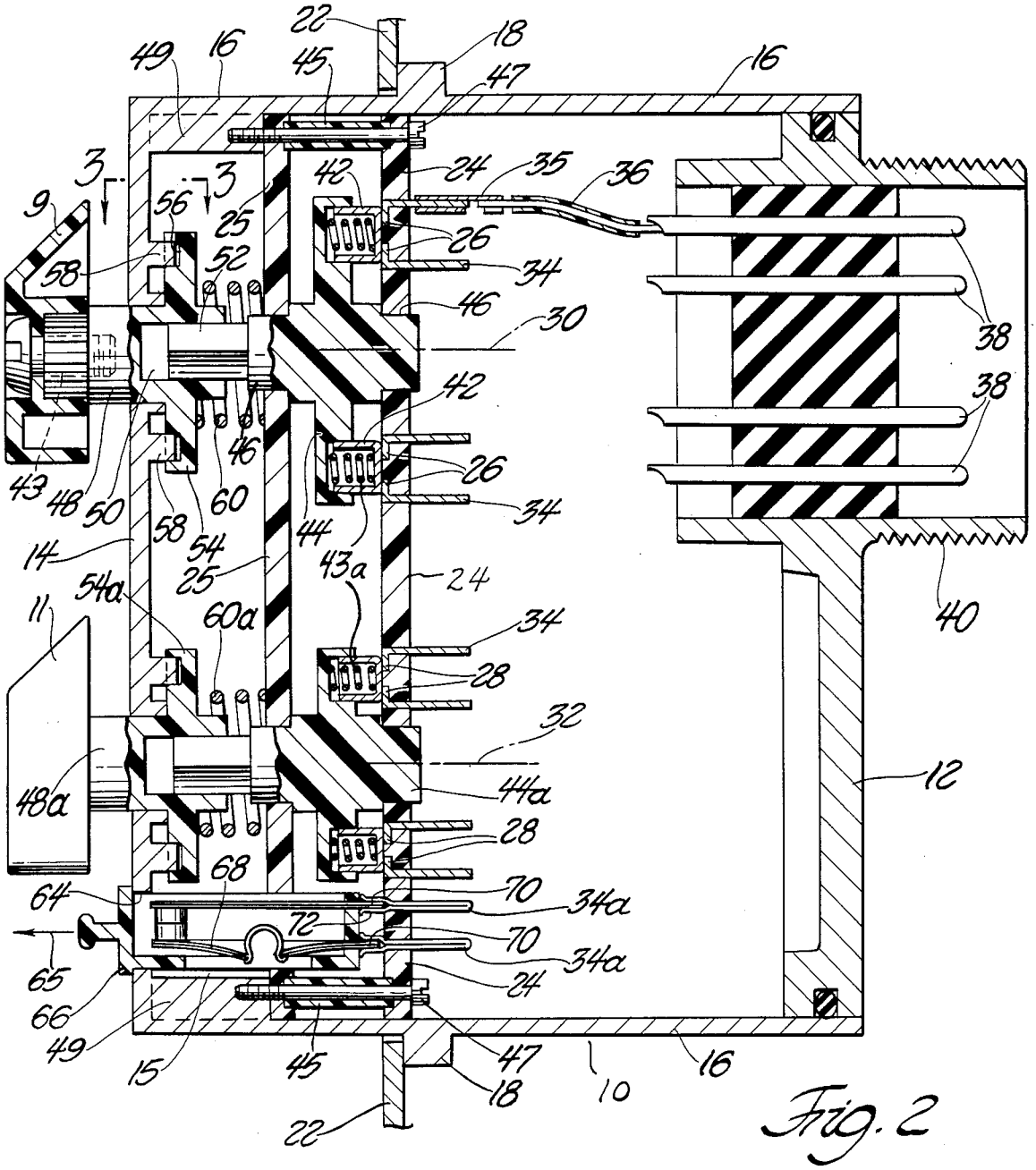
FIG. 2 is a sectional view on line 2—2 in FIG. 1.

Referring to FIG. 2, there is shown a dielectric circuit board 24 having two sets of electrical contacts 26 and 28 thereon. Contacts 26 are arranged in a circular pattern (or patterns) around an imaginary central axis 30. Contacts 28 are arranged in a circular pattern (or patterns) around an imaginary central axis 32. The various contacts 26 and 28 are equipped with spade terminals 34 that are designed to detachably receive gripper-type end connectors 35 carried on flexible insulated wires 36 (only one of which is shown in the drawing). In general, each flexible wire 36 has a soldered connection with a pin terminal 38 located within receptacle 40 that is an integral part of cover 12. The number of terminals 38 will vary with the type of installation. However, in one case there are twelve pin terminals 38 (and a corresponding number of spade terminals 34). Receptacle 40 is designed to receive a non-illustrated electrical plug carried on a cable having individual wires leading to different ones of the vehicle lights. The described structure is conventional.

Current flows across contact elements 26 are controlled by a switch element that comprises electrically conductive bridge elements 42 carried on a dielectric disk 44. A compression coil spring **43*a* may be associated with each bridge element 42 to bias said element toward board 24. Circular end areas 46 of disk 44 are rotatably received in aligned circular openings in board 24 and a second support board 25. Boards 24 and 25 may be identical as to outline shape and hole placement. Each board has an outline configuration corresponding to the cross-sectional configuration of the chamber defined by housing 10, such that the two boards can be installed through the housing rear opening (closed by cover 12**).

Disk 44 is rotatable around axis 30, such that different circuits are completed through different selected contacts in different selected positions of disk 44. Boards 24 and 25 jointly support disk 44 for rotary motion.

Boards 24 and 25 are spaced apart by means of tubular spacers 45 located at spaced points around peripheral edge areas of the boards; in a typical case there would be four spacers 45 spaced equidistantly around the board periphery. Screws 47 may be extended through the tubular spacers into threaded holes in bosses 49 that are formed integrally with housing 10. The two boards 24 and 25 (With switch element 44 and a second switch element 44a) can be installed as a unit in housing 10, using screws 47.

The aforementioned knob 9 is secured to a shaft 48 via a screw 43. The rear end area of shaft 48 has a square cross-sectioned socket 50 that mates with a square cross-sectioned projection 52 formed on the aforementioned dielectric element 44. In the FIG. 2 position of knob 9 projection 52 extends only part way into socket 50, such that knob 9 can be pushed axially toward the external surface of housing wall 14 without disturbing (breaking) the drive connection between socket 50 and projection 52. After the knob has been pushed in it can be rotated to effect rotation of dielectric switch element 44 (via drive connection 50,52).

Shaft 48 carries a radial wall structure 54 whose front face has a number of circumferentially-spaced recesses 56 formed therein. The rear face of housing wall 14 has two detents (projections) 58 thereon cooperable with recesses 56, to releasably retain shaft 48 in various selected positions of adjustment. The two detents 58 are oriented directly above and directly below the shaft axis, although other locations are possible.

A coil spring 60 is trained between board 25 and the rear face of wall structure 54 to bias the wall structure toward wall 14. The spring maintains detents 58 engaged with the registering recesses 56.

Figure 3:
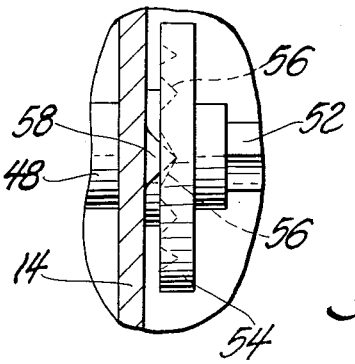
FIG. 3 is fragmentary view on line 3—3 in FIG. 2.

As seen in FIG. 3, detents 58 and recesses 56 have pyramidal contours in the cicumferential direction. Such a contour is advantageous in that it facilitates accurate positionment of the rotary assembly even though knob 9 is not turned to precise registry with the indicia on the front face of wall 14 (FIG. 1). The convergent tip areas of detents 58 have cam actions on the convergent surfaces of recesses 56.

In the absence of a manual push-in force on knob 9 spring 60 will maintain wall structure 54 in its FIG. 2 position, wherein the rotary assembly is locked in selected positions of adjustment. Rotation of knob 9 (and associated elements 48 and 44) can only be accomplished after a push-in action on the knob.

The aforementioned knob 11 is associated with a second shaft 48a and second rotary switch element 44a. Elements 48a and 44a are constructed similarly to the corresponding elements 48 and 44. Knob 11 is operated in the same fashion as knob 9.

The aforementioned circuit breaker 15 is constructed as a drawer-type unit capable of movement through an opening 64 in housing wall 14, as designated by numeral 65 (FIG. 2). The breaker is of generally conventional "cyclable" design, comprised of a dielectric body 66 and bimetal mechanism 68. In FIG. 2 the circuit breaker contacts ar shown at the left ends of the two bimetal strips. The lower bimetal strip is the thermally-responsive snap-action member; the upper bimetal strip is an ambient temperature-compensation member. Electrical prongs 70 project through the rear wall of dielectric body 66 for reception in grasp-type electrical connectors 72 permanently mounted on circuit board 24. Connectors 72 are aligned with opening 64 in wall 14 so that when the circuit breaker unit is pushed into housing 10 the electrical prongs 70 will be automatically grasped by grip-type connectors 72. The grip-type connections are sufficient to retain the circuit breaker structure in place.

Connectors 72 project through board 24 to form spade terminals 34a. Flexible wires (similar to wires 36) may be detachably connecte between a circuit breaker terminal 34a and a terminal 34 associated with switch element 44; the electrical connections may be made via slip-on connectors of the type shown at 35 in FIG. 2. The other spade terminal 34a of the circuit breaker may be electrically connected to one of the pin terminals 38 in receptacle 40 so that when the circuit breaker contacts open (e.g. excessive current surge) the various circuits controlled by knob 9 are automatically interrupted.

My invention is primarily concerned with the releasable retainer mechanism that holds knob 9 (and knob 11) in selected positions of adjustment. The circuit breaker 15 location forms a secondary feature of my invention.

The releasable retainer mechanism comprises wall structure 54, detents 58, and recesses 56. The retainer structure adds some expense to the selector switch device. However, in reasonable production quantities the added expense would be relatively small. Preferably the two individual switch assemblies (controlled by knobs 9 and 11) are formed out of dimensionally similar components to minimize tooling-production expense.

FIG. 2 illustrates the actual electrical connections (at 44, 26 and 28) in a semi-schematic fashion. Actual electrical contacts would be constructed similarly to the contacts now used in the existing switch (that my invention is designed to replace).

The drawings show both switch-actuation knobs 9 and 11 as being of push-to-rotate type. Each knob has a releasable retainer means 56, 58 associated therewith for holding the respective knob in a selected position of adjustment (except when the knob is deliberately pushed in toward housing wall 14). However, the switch associated with knob 11 does not have to be of the "lockable" type. That switch could be a simple rotary switch without the push-in feature.

The drawings show the switch releasable retainer means as including recesses 56 in the front face of wall structure 54 and projections 58 on the rear face of housing wall 14. The reverse arrangement could be employed, i.e. the recesses could be formed on wall 14 and the projections on wall structure 54.

The housing components and switch components may be formed of various different materials. I presently contemplate that housing components 10 and 12 will be metal die castings, and that switch components 44 and 48 will be plastic moldings. Dielectric boards 24 and 25 will be generally similar to one another, except that board 24 will have terminals 34 mounted thereon. Switch components 44 and 44a will preferably be assembled into positions between boards 24 and 25 prior to installation thereof into housing 10. Spacers 45 may be adhesively secured to boards 24 and 25 during formation of the switch-board sub-assembly. When the subassembly is secured in housing 10 (via screws 47) boards 24 and 25 cooperatively support switch elements 44 and 44a for rotation.

The various end connectors 35 (on wires 36) are preferably inserted onto terminals 34 prior to insertion of cover 12 into the rear end of housing 10. Wires 36 are made of sufficient length to make the desired connections while cover 12 is displaced rearwardly from housing 10.

For military applications the switch housing structure may need to be waterproof. To provide a waterproof construction gasket structures can be provided on housing front wall 14 at circuit breaker 15, shaft 48 and shaft 48*a*. For example, an O-ring seal may be provided around each shaft 48 or 48*a*; a gasket can be adhered to the front wall of the circuit breaker structure 66 where it contacts the front face of wall 14.

I wish it to be understood that I do not desire to be limited to the exact details of construction shown and described for obvious modifications will occur to a person skilled in the art, without departing from the spirit and scope of the appended claims.

I claim:

1. A rotary selector switch comprising a housing; a circuit board immovably disposed within the housing; a series of spaced electrical contacts located on one face of the circuit board in a circumferential pattern around a central axis normal to the plane of the circuit board; a switch element arranged for rotary motion around said central axis; said switch element comprising a dielectric disk having at least one electrically conductive bridge member thereon oriented to span the spaces between selected electrical contacts on the circuit board; manual means for operating the rotary switch element so that different circuits are completed in different selected positions of the switch element; said manual means comprising a manual knob located in an external position near a front wall of the housing and a shaft extending from the knob through an opening in the housing front wall, said shaft having a slidable key-type connection with the rotary switch element whereby the knob-shaft assembly can slide axially along the aforementioned central axis while maintaining a rotary driving connection with the switch element; and releasable retainer means for holding the knob-shaft assembly in selected positions of rotary adjustment; said retainer means comprising a radial wall structure carried on the shaft in near adjacency to an internal surface of the housing front wall, a detent on one of said radial wall structure and housing internal surface, and a series of circumferentially spaced recesses in the other of said wall structure and housing internal surface; said recesses being circumferentially spaced so that when a manual turning force is applied to the knob the detent is caused to pass across successive ones of the recesses; and a compression coil spring encircling the shaft for urging the radial wall structure toward said housing internal surface, whereby the detent is normally engaged in one of the recesses to prevent rotation of the knob-shaft assembly; said knob being manually movable toward the housing front wall so that the radial wall structure is moved axially to disengage the detent from any of the associated recesses.

2. The selector switch of claim 1 wherein the slidable key-type connection comprises a non-circular socket formed in the shaft and a mating non-circular projection carried by the switch element.

3. A rotary selector switch structure comprising a housing having a front wall; a circuit board (24) and a support board (25) immovably disposed within the housing in spaced parallelism to the housing front wall; a series of spaced electrical contacts located on the front face of the circuit board in a circumferential pattern around a central axis normal to the plane of the circuit board; a switch element arranged between the two boards for rotary motion around said central axis; said switch element comprising a dielectric disk having circular pivot areas (46) mounted in openings in the boards, said disk having at least one electrically conductive bridge member thereon oriented to span the spaces between selected electrical contacts on the circuit board; manual means for operating the rotary switch element so that different circuits are completed in different selected positions of the switch element; said manual means comprising a manual knob located in an external positin near a front wall of the housing and a shaft extending from the knob through an opening in the housing front wall, said shaft having a slidable key-type connection with the rotary switch element whereby the knob-shaft assembly can slide axially along the aforementioned central axis while maintaining a rotary driving connection with the switch element; and releasable retainer means for holding the knob-shaft assembly in selected positions of rotary adjustment; said retainer means comprising a radial wall structure carried on the shaft in near adjacency to an internal surface of the housing front wall, a detent on one of said radial wall structure and housing internal surface, and a series of circumferentially spaced recesses in the other of said wall structure and housing internal surface; said recesses being circumferentially spaced so that when a manual turning force is applied to the knob the detent is caused to pass across successive ones of the recesses; and a compression coil spring encircling the shaft for urging the radial wall structure toward said housing internal surface, whereby the detent is normally engaged in one of the recesses to prevent rotation of the knob-shaft assembly; said knob being manually movable toward the housing front wall so that the radial wall structure is moved axially to disengage the detent from any of the associated recesses.

4. The selector switch structure of claim 3 and further comprising a circuit breaker removably mounted in the housing for protecting the circuits defined by the rotary switch element; said circuit breaker comprising a drawer structure movable into or out of the housing through an opening in the housing front wall; said circuit housing board having first electrical connectors thereon aligned with said drawer structure opening; said drawer structure having second mating electrical connectors grasped by the first electrical connectors when the drawer structure is moved into the housing.

5. The switch structure of claim 3 and further comprising a series of tubular spacers (45) arranged between the circuit board and support board at selected points near the board peripheries; and fasteners (47) extending through the tubular spacers to mount the boards in the housing.

6. The selector switch structure of claim 3 and further including a second switch element arranged between the two boards for rotary motion around a second axis normal to the plane of the circuit board; a second series of spaced electrical contacts located on the front face of the circuit board in a circumferential pattern around the second axis; said second switch element comprising a second dielectric disk having circular pivot areas mounted in circular openings in the boards, said second disk having at least one electrically conductive bridge member thereon oriented to span the spaces between selected ones of the second electrical contacts; and second manual means for operating the second switch element so that different circuits are completed in different selected positions of the second switch element; said second manual means comprising a manual knob (11) located in an external position near the front wall of the housing.

7. The selector switch structure of claim 6 wherein the housing is installable on a vehicle instrument panel, wth the first and second manual knobs accessible to the the person driving the vehicle; the first series of electrical contacts controlling the current flow to the vehicle headlights and stop lights; the second series of electrical contacts controlling current flow to the vehicle parking lights and instrument panel lights; the housing being mountable on the substantially in a vertical plane, with the second manual knob being located directly below the first manual knob; the knobs being spaced from one another so that each knob is independently movable by the person driving the vehicle.

8. A rotary selector switch structure comprising a housing; a circuit board (24) disposed within the housing; a series of spaced electrical contacts located in said circuit board; a rotary switch element (44) arranged within the housing; at least one bridge member (42) carried on the switch element to complete circuits across selected electrical contacts on the board; manual means for operating the rotary switch element so that different circuits are completed in different selected positions of the switch element; said manual means comprising a manual knob located in an external position near a front wall of the housing, and a shaft extending from the knob through an opening in the housing front wall, said shaft having a slidable key-type connection with the rotary switch element whereby the knob-shaft assembly can slide axially while maintaining a rotary driving connection with the switch element; and releasable retainer means for holding the knob-shaft assembly in selected positions of rotary adjustments; said retainer means comprising a radial wall structure carried on the shaft in near adjacency to an internal surface of the housing front wall, a detent on one of said radial wall structure and housing internal surface, and a series of circumferentially spaced recesses in the other of said wall structure and housing internal surface; said recesses being circumferentially spaced so that when a manual turning force is applied to the knob the detent is caused to pass across successive ones of the recesses; and a compression spring means disposed within the housing for urging the radial wall structure toward said housing internal surface, whereby the detent is normally engaged in one of the recesses to prevent rotation of the knob-shaft assembly; said knob being manually movable toward the housing front wall so that the detent from any of the associated recesses.

9. The selector switch of claim 8 wherein the detent and cooperating recesses have pyramidal contours in the circumfernetial direction, whereby the detent tends to automatically seek a centered position in each selected recess when manual force on the knob turns the detent into a position offset from the center recess.

* * * * *